US005275669A

United States Patent [19]

Van Der Puy et al.

[11] Patent Number: 5,275,669

[45] Date of Patent: Jan. 4, 1994

[54] METHOD OF DISSOLVING CONTAMINANTS FROM SUBSTRATES BY USING HYDROFLUOROCARBON SOLVENTS HAVING A PORTION WHICH IS FLUOROCARBON AND THE REMAINING PORTION IS HYDROCARBON

[75] Inventors: Michael Van Der Puy, Cheektowaga; Phillip J. Persichini, Hamburg; Andrew J. Poss, Amherst; Lois A. Shorts; Richard E. Eibeck, both of Orchard Park, all of N.Y.

[73] Assignee: AlliedSignal Inc., Morris Township, Morris County, N.J.

[21] Appl. No.: 746,273

[22] Filed: Aug. 15, 1991

[51] Int. Cl.[5] ..... B08B 3/00; C11D 7/30; C11D 7/50; C23G 5/028

[52] U.S. Cl. ..... 134/42; 252/171

[58] Field of Search ..... 134/42; 252/171

[56] References Cited

FOREIGN PATENT DOCUMENTS 381986 8/1990 European Pat. Off. .

OTHER PUBLICATIONS

Giacometti et al., Canadian Journal of Chemistry, 36, 1493 (1958).

Groth, Journal of Organic Chemistry 24, 1709 (1959).

Kim et al., Journal of Organic Chemistry 38(8) 1615 (1973).

*Primary Examiner*—Mark L. Bell

*Assistant Examiner*—Zeinab El-Arini

*Attorney, Agent, or Firm*—Colleen D. Szuch; Jay P. Friedenson

[57] ABSTRACT

The present invention provides hydrofluorocarbon solvents having a portion which is fluorocarbon and the remaining portion is hydrocarbon and having 4 to 7 carbon atoms. The solvents are useful for dissolving contaminants or removing contaminants from the surface of a substrate.

15 Claims, No Drawings

METHOD OF DISSOLVING CONTAMINANTS FROM SUBSTRATES BY USING HYDROFLUOROCARBON SOLVENTS HAVING A PORTION WHICH IS FLUOROCARBON AND THE REMAINING PORTION IS HYDROCARBON

BACKGROUND OF THE INVENTION

The present invention relates to hydrofluorocarbons, and more particularly, to hydrofluorocarbon solvents having a portion which is fluorocarbon and the remaining portion is hydrocarbon.

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists of exposing a room-temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the act. For example, Sherliker et al. in U.S. Pat. No. 3,085,918 disclose such suitable vapor degreasers comprising a boiling sump, a clean sump, a water separator, and other ancilliary equipment.

Cold cleaning is another application where a number of solvents are used. In most cold cleaning applications, the soiled part is either immersed in the fluid or wiped with rags or similar objects soaked in solvents.

Chlorofluorocarbon solvents, such as trichlorotrifluoroethane, have attained widespread use in recent years as effective, nontoxic, and nonflammable agents useful in degreasing and other solvent cleaning applications. Trichlorotrifluoroethane has been found to have satisfactory solvent power for greases, oils, waxes, and the like. It has therefore found widespread use for cleaning electric motors, compressors, heavy metal parts, delicate precision metal parts, printed circuit boards, gyroscopes, guidance systems, aerospace and missile hardware, aluminum parts, and the like. Trichlorotrifluoroethane has two isomers: 1,1,2-trichloro-1,2,2-trifluoroethane (known in the art as CFC-113) and 1,1,1-trichloro-2,2,2-trifluoroethane (known in the art as CFC-113a).

Chlorofluorocarbons such as CFC-113 are suspected of causing environmental problems in connection with the ozone layer. In response to the need for stratospherically safe materials, substitutes have been developed and continue to be developed. For example, commonly assigned U.S. Pat. No. 4,947,881 teaches a method of cleaning using hydrochlorofluorocarbons having 2 chlorine atoms and a difluoromethylene group.

A need exists in the art for a class of solvents which have zero ozone depletion potentials, have boiling point ranges suitable for a variety of solvent applications, and have the ability to dissolve both hydrocarbon based and fluorocarbon based soils. From an environmental standpoint, hydrocarbons (compounds having hydrogen and carbon), fluorocarbons (compounds having fluorine and carbon), and hydrofluorocarbons (compounds having hydrogen, fluorine, and carbon) are of interest because they are considered to be stratospherically safe substitutes for the currently used CFCs.

G. Giacometti et al., "The Gas Phase Reactions of Perfluoro-n-propyl Radicals with Methane and Ethane," *Canadian Journal of Chemistry*, 36, 1493 (1958) teach a method for the preparation of $C_5F_7H_5$ but do not teach or suggest that it would be useful as a solvent.

R. H. Groth, "Fluorinated Paraffins", *J. Org. Chem.* 24, 1709 (1959) teaches a method for the preparation of $C_3F_7C_3H_7$ but does not teach or suggest that it would be useful as a solvent.

Yung K. Kim et al., "Isomeric 2,4,6-Tris(3,3,4,4,5,5,6,6,6-nonafluorohexyl)-2,4,6-trimethylcyclotrisiloxanes", *J. Org. Chem.* 38(8), 1615(1973) teach a method for the preparation of 1,1,1,2,2,3,3,4,4-nonafluorohexane but do not teach or suggest that it would be useful as a solvent.

European Patent Publication 381,986 published Aug. 16, 1990 teaches hydrofluorocarbons having 3 to 6 carbon atoms.

The problem with hydrocarbon solvents is that although they are excellent solvents for hydrocarbon solutes as shown in Comparative G in Table V below, they have limited ability to dissolve highly fluorinated solutes. The problem with fluorocarbon solvents is that although they are excellent solvents for fluorocarbon solutes such as perfluorinated ethers, they are very poor solvents for hydrocarbons as shown in Comparative L in Table V below.

Turning to hydrofluorocarbons, we tested potential solvents for their ability to dissolve, in order of decreasing molecular weight: (a) hydrocarbons: paraffinic light mineral oil (maximum Saybolt viscosity 158), hexadecane (molecular weight 226), dodecane (molecular weight 170), decane (molecular weight 142), octane (molecular weight 114), heptane (molecular weight 100), and hexane (molecular weight 86) and (b) fluorocarbon: perfluorinated polyether (molecular weight 3500). The hydrocarbon listed in the tables below for each comparative and example is the maximum weight hydrocarbon that was miscible with (a 1:1 volume ratio of solute and solvent were homogeneous) the comparative or example.

We found that although mineral oil solute is miscible with hydrofluorocarbon solvents such as $CH_3CH_2CF_2CH_2CH_3$ as shown in Comparative H in Table V below, the perfluorinated polyether solute is insoluble in $CH_3CH_2CF_2CH_2CH_3$ and $CH_2FCH_2CH_2F$ solvents as shown in Comparatives H and M in Table VII below and thus, $CH_3CH_2CF_2CH_2CH_3$ and $CH_2FCH_2CH_2F$ are unsuitable for use as solvents with both hydrocarbon and fluorocarbon solutes.

Relative to hydrofluoropentane solvents, we found that mineral oil solute is miscible with $CH_3(CF_2)_2CH_2CH_3$ which has 53 weight percent fluorine as shown in Comparative F in Table V below. We found that dodecane solute is miscible with each of the following solvents: $CH_3CF_2CH_2CF_2CH_3$ which has 53 weight percent fluorine, $CH_3(CF_2)_3CH_3$ which has 63 weight percent fluorine, and $CF_3(CH_3)CHCH_2CF_3$ which has 63 weight percent fluorine, as shown in Comparatives A, E, and I respectively in Table V below. We found that decane is miscible with $HCF_2CF_2CH_2CH_2CF_3$ which has 67 weight percent fluorine as shown in Comparative J in Table V below. We found that octane solute is miscible with $CF_3CH_2CH(CF_3)_2$ which has 73 weight percent fluorine as shown in comparative K in Table V below. We found that hexane solute is miscible with $CF_3CH_2CF_2CH_2CF_3$ which has 70 weight percent fluorine as shown in Comparative B in Table V below.

Relative to hydrofluorohexane solvents, we found that decane solute is miscible with each of the following solvents: $CF_3(CF_2)_2CH_2CHFCH_3$ which has 66 weight percent fluorine as shown in comparative C in Table VI below.

SUMMARY OF THE INVENTION

We were surprised to find that hydrofluorocarbons having a portion which is fluorocarbon and the remaining portion is hydrocarbon and having 4 to 7 carbon atoms dissolve higher molecular weight hydrocarbons or dissolve more of the same molecular weight hydrocarbon than isomers which do not have a portion which is fluorocarbon and the remaining portion is hydrocarbon.

Thus, the present invention provides a method of dissolving contaminants or removing contaminants from the surface of a substrate which comprises the step of: using at least one solvent of the Formula (I)

$$C_nF_{2n+1}C_mH_{2m+1}$$

wherein n is 2, 3, or 4 and m is 2 or 3. Based on Formula (I), these hydrochlorofluorocarbon solvents have about 62 to 69 weight percent fluorine. Examples of these solvents are in Table I below.

TABLE I

| Formula | Name |
|---|---|
| $CF_3CF_2CH_2CH_3$ | 1,1,1,2,2-pentafluorobutane |
| $CF_3CF_2(CH_2)_2CH_3$ | 1,1,1,2,2-pentafluoropentane |
| $CF_3CF_2CH(CH_3)_2$ | 2-methyl-3,3,4,4,4-pentafluorobutane |
| $(CF_3)_2CFCH_2CH_3$ | 2-trifluoromethyl-1,1,1,2-tetrafluorobutane |
| $CF_3(CF_2)_2CH_2CH_3$ | 1,1,1,2,2,3,3-heptafluoropentane |
| $CF_3(CF_2)_2(CH_2)_2CH_3$ | 1,1,2,2,3,3-heptafluorohexane |
| $(CF_3)_2CF(CH_2)_2CH_3$ | 2-trifluoromethyl-1,1,1,2-tetrafluoropentane |
| $CF_3(CF_2)_2CH(CH_3)_2$ | 4-methyl-1,1,1,2,2,3,3-heptafluoropentane |
| $(CF_3)_2CFCH(CH_3)_2$ | 3-methyl-2-trifluoromethyl-1,1,1,2-tetrafluorobutane |
| $CF_3(CF_2)_3CH_2CH_3$ | 1,1,1,2,2,3,3,4,4-nonafluorohexane |
| $(CF_3)_2CFCF_2CH_2CH_3$ | 2-trifluoromethyl-1,1,1,2,3,3-hexafluoropentane |
| $(CF_3)_3CCH_2CH_3$ | 2,2-(bis)trifluoromethyl-1,1,1-trifluorobutane |
| $C_2F_5C(F)CF_3(CH_2CH_3)$ | 1,1,1,2,2,3-hexafluoro-3-trifluoromethylpentane |
| $CF_3(CF_2)_3(CH_2)_2CH_3$ | 1,1,1,2,2,3,3,4,4-nonafluoroheptane |
| $CF_3(CF_2)_3CH(CH_3)_2$ | 5-methyl-1,1,1,2,2,3,3,4,4-nonafluorohexane |
| $(CF_3)_2CFCF_2(CH_2)_2CH_3$ | 2-trifluoromethyl-1,1,1,2,3,3-hexafluorohexane |
| $(CF_3)_2CFCF_2CH(CH_3)_2$ | 4-methyl-2-trifluoromethyl-1,1,1,2,3,3-hexafluoropentane |
| $(CF_3)_3C(CH_2)_2CH_3$ | 2,2-trifluoromethyl-1,1,1-trifluoropentane |
| $(CF_3)_3CCH(CH_3)_2$ | 3-methyl-2,2-trifluoromethyl-1,1,1-trifluorobutane |
| $C_2F_5C(F)CF_3(CH_2CH_2CH_3)$ | 1,1,1,2,2,3-hexafluoro-3-trifluoromethylhexane |
| $C_2F_5C(F)CF_3(CH(CH_3)_2)$ | 1,1,1,2,2,3-hexafluoro-3-trifluoromethyl -4-methylpentane |

To illustrate the unexpected properties of the present hydrofluorocarbon solvents, one solvent of the present invention is $(CF_3)_2CFCH_2CH_3$ which is Example 1 below and another solvent of the present invention is $CF_3(CF_2)_2CH_2CH_3$ which is Example 2 in Table V below. As shown in Table V below, hexadecane solute was soluble in each of the solvents of Examples 1 and 2 at 25° C. In contrast, hexadecane solute was insoluble in the isomer, $HCF_2CF_2CH_2CH_2CF_3$, as shown by Comparative J in Table V below.

As further examples of the unexpected properties of the present hydrofluorocarbon solvents, other solvents of the present invention are $CF_3(CF_2)_2(CH_2)_2CH_3$ which is Example 3 below, $CF_3(CF_2)_2CH(CH_3)_2$ which is Example 4 below, and $(CF_3)_2CFCH(CH_3)_2$ which is Example 6 below. As shown in Table VI below, hexadecane solute was miscible with each of the solvents of Examples 3, 4, and 6 at 25° C. In contrast, hexadecane solute is insoluble in the isomer, $CF_3CH_2CF_2CH_2CF_2CH_3$.

The results of the present invention are also unexpected in view of predictions based on three dimensional solubility parameters which suggest that structural isomers such as $CH_3CF_2CH_2CF_2CH_3$ and $CH_3CF_2CF_2CH_2CH_3$ should possess similar solvency according to A. F. Barton, HANDBOOK OF SOLUBILITY PARAMETERS, CRC Press, 1983, pages 64 and 85.

Increasing n while keeping m constant in Formula (I) above results in a lower solubility for hydrocarbons. Increasing m while keeping n constant in Formula (I) above results in a lower solubility for fluorocarbons.

The preferred hydrofluorocarbon solvents of Table I are 2-trifluoromethyl-1,1,1,2-tetrafluorobutane and 2,2-(bis)trifluoromethyl-1,1,1-trifluorobutane. The most preferred hydrofluorocarbon solvent of Table I is 2-trifluoromethyl-1,1,1,2-tetrafluorobutane.

The hydrofluorocarbon solvents of Table I are made by adapting known methods for the preparation of hydrofluorocarbons. For example, 2-trifluoromethyl-1,1,1,2-tetrafluorobutane may be prepared by reacting commercially available 4-iodo-2-trifluoromethyl-1,1,1,2-tetrafluorobutane with zinc dust and hydrogen chloride.

The present invention also provides a method of dissolving contaminants or removing contaminants from the surface of a substrate which comprises the step of: using at least one solvent of the Formula (II)

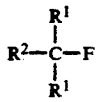

having 4 to 7 carbon atoms wherein $R^1$ is the same or different and is selected from the group consisting of $-CH_3$ and $-C_2H_5$ and $R^2$ is selected from the group consisting of $-CF_3$, $-CF_2CF_3$, $-(CF_2)_2CF_3$, and $-FC(CF_3)_2$. Examples of these solvents are in Table II below.

TABLE II

| FORMULA | NAME |
|---|---|
| $CF_3CF(CH_3)_2$ | 2-trifluoromethyl-2-fluoropropane |
| $CF_3CF(C_2H_5)(CH_3)$ | 2-methyl-1,1,1,2-tetrafluorobutane |
| $CF_3CF_2CF(C_2H_5)(CH_3)$ | 3-methyl-1,1,1,2,2,3-hexafluoropentane |
| $CF_3(CF_2)_2CF(C_2H_5)(CH_3)$ | 4-methyl-1,1,1,2,2,3,3,4-octafluorohexane |
| $(CF_3)_2C(F)CF(C_2H_5)(CH_3)$ | 3-methyl-2-trifluoromethyl-1,1,1,2,3-pentafluoropentane |

The hydrofluorocarbon solvents of Table II are made by adapting known methods for the preparation of hydrofluorocarbons.

The present invention also provides a method of dissolving contaminants or removing contaminants from the surface of a substrate which comprises the step of: using at least one solvent of the Formula (III)

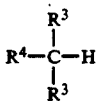

having 4 to 7 carbon atoms wherein $R^3$ is the same or different and is selected from the group consisting of $-CF_3$, $-C_2F_5$, and $-C_3F_7$ and $R^4$ is selected from the group consisting of $-CH_3$ and $-C_2H_5$ with the proviso that both of $R^3$ cannot be $-CF_3$. Examples of these solvents are in Table III below.

TABLE III

| FORMULA | NAME |
|---|---|
| $CH_3CH(C_2F_5)(CF_3)$ | 2-methyl-1,1,1,3,3,4,4,4-octafluorobutane |
| $CH_3CH(C_2F_5)_2$ | 3-methyl-1,1,1-2,2,4,4,5,5,5-decafluoropentane |
| $CH_3CH(C_3F_7)(CF_3)$ | 2-methyl-1,1,1,3,3,4,4,5,5,5-decafluoropentane |
| $CH_3CH_2CH(C_2F_5)(CF_3)$ | 3-trifluoromethyl-1,1,1,2,2-pentafluoropentane |
| $CH_3CH_2CH(C_2F_5)_2$ | 3-pentafluoroethyl-1,1,1,2,2-pentafluoropentane |
| $CH_3CH_2CH(C_3F_7)(CF_3)$ | 4-trifluoromethyl-1,1,1,2,2,3,3-heptafluorohexane |

The hydrofluorocarbon solvents of Table III are made by adapting known methods for the preparation hydrofluorocarbons.

The present invention also provides hydrofluorocarbons of the Formula (IV)

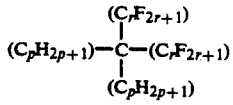

wherein p is 1, 2, or 3 and r is 1,2, or 3. Examples are in Table IV below.

TABLE IV

| FORMULA | NAME |
|---|---|
| $C(CH_3)_2(CF_3)_2$ | 2-methyl-2-trifluoromethyl-1,1,1-trifluoropropane |
| $C(CH_3)_2(CF_3)(C_2F_5)$ | 2-methyl-2-trifluoromethyl-3,3,4,4,4-pentafluorobutane |
| $C(CH_3)(C_2H_5)(CF_3)_2$ | 2-methyl-2-trifluoromethyl-1,1,1-trifluorobutane |
| $C(CH_3)_2(C_2F_5)_2$ | 3,3-dimethyl-1,1,1,2,2,4,4,5,5,5-decafluoropentane |
| $C(CH_3)(C_2H_5)(CF_3)(C_2F_5)$ | 3-methyl-3-trifluoromethyl-1,1,1,2,2-pentafluoropentane |
| $C(C_2H_5)_2(CF_3)_2$ | 3,3-bis(trifluoromethyl)pentane |
| $C(CH_3)_2(CF_3)(C_3F_7)$ | 2,2-dimethyl-1,1,1,3,3,4,4,5,5,5-decafluoropentane |
| $C(CH_3)(C_3H_7)(CF_3)_2$ | 2-methyl-2-trifluoromethyl-1,1,1-trifluoropentane |

The preferred hydrofluorocarbons of Table IV are 2-methyl-2-trifluoromethyl-1,1,1-trifluoropropane; 2-methyl-2-trifluoromethyl-3,3,4,4,4-pentafluorobutane; 3,3-dimethyl-1,1,1,2,2,4,4,5,5,5-decafluoropentane; and 2,2-dimethyl-1,1,1,3,3,4,4,5,5,5-decafluoropentane. The most preferred hydrofluorocarbons of Table IV are 2-methyl-2-trifluoromethyl-1,1,1-trifluoropropane and 2-methyl-2-trifluoromethyl-3,3,4,4,4-pentafluorobutane.

The branched hydrofluorocarbons of Table IV are made by adapting known methods for the preparation of hydrofluorocarbons.

Increasing r while keeping p in Formula (IV) above results in a lower solubility for hydrocarbons. Increasing p while keeping r constant in Formula (IV) above results in a lower solubility for fluorocarbons.

The present invention also provides a method of dissolving contaminants or removing contaminants from the surface of a substrate which comprises the step of: using a hydrofluorocarbon of Formula (IV) as solvent.

Other advantages of the present invention will become apparent from the following description.

DETAILED DESCRIPTION OF THE PREFERRED EMBODIMENTS

The present method dissolves or removes most contaminants from the surface of a substrate. For example, the present method removes organic contaminants such as hydrocarbons, fluorocarbons, mineral oils from the surface of a substrate. Under the term "mineral oils", both petroleum-based and petroleum-derived oils are included. Lubricants such as engine oil, machine oil, and cutting oil are examples of petroleum-derived oils.

The solvents of the present invention have boiling points ranging from about 40° C. to about 100° C. The higher boiling solvents allow greater amounts of soil to be dissolved when used near their boiling points.

The present method also removes water from the surface of a substrate. The method may be used in the single-stage or multi-stage drying of objects.

The present method may be used to clean the surface of inorganic and organic substrates. Examples of inorganic substrates include metallic substrates, ceramic substrates, and glass substrates. Examples of organic substrates include polymeric substrates such as polycarbonate, polystyrene, and acrylonitrile-butadiene-styrene. The method also may be used to clean the surface of natural fabrics such as cotton, silk, fur, suede, leather, linen, and wool. The method also may be used to clean the surface of synthetic fabrics such as polyester, rayon, acrylics, nylon, and blends thereof, and blends of synthetic and natural fabrics. It should also be understood that composites of the foregoing materials may be cleaned by the present method. The present method may be particularly useful in cleaning the surface of polycarbonate, polystyrene, and ABS substrates.

The present method may be used in vapor degreasing, solvent cleaning, cold cleaning, dewatering, and dry cleaning. In these uses, the object to be cleaned is immersed in one or more stages in the liquid and/or vaporized solvent or is sprayed with the liquid solvent. Elevated temperatures, ultrasonic energy, and/or agitation may be used to intensify the cleaning effect.

The present invention is more fully illustrated by the following non-limiting examples.

COMPARATIVE A

This comparative is directed to the preparation of $CH_3CF_2CH_2CF_2CH_3$ or 2,2,4,4-tetrafluoropentane.

A 300 milliliter autoclave was charged with 18 milliliters (0.175 mole) 2,4-pentanedione, cooled to −40° C., and charged with 45 grams (0.417 mole) $SF_4$. The mixture was stirred for 48 hours at room temperature, and vented to an aqueous potassium hydroxide scrubber. The autoclave contents were poured into 30 milliliters water and steam distilled. The organic layer was dried with magnesium sulfate to afford 6.5 grams (26% yield) of $CH_3CF_2CH_2CF_2CH_3$, boiling point 72°-78° C. (literature (I. V. Stepanov et al., *J. Org. Chem. USSR, Engl. Transl.* 19, 244 (1983) 75° C.). 1H NMR ($CDCl_3$): δ 1.53 (t, 6 H, J=19.5 Hz), 2.21 (pentet, 2 H, J=15 Hz). 19F NMR: 87 (m) upfield from $CFCl_3$. As shown in Table V below, this Comparative hydrofluorocarbon was immiscible with hexadecane at 25° C.

COMPARATIVE B

This comparative is directed to the preparation of $CF_3CH_2CF_2CH_2CF_3$ or 1,1,1,3,3,5,5,5-octafluoropentane.

A 300 milliliter autoclave was charged with 8.5 grams 1,3-acetonedicarboxylate (0.058 mole), 10.5 grams hydrogen fluoride (0.521 mole), and 50 grams (0.463 mole) sulfur tetrafluoride at −40° C. The mixture was then heated to 30° C. for 4 hours and to 120° C. for 16 hours. The autoclave was vented through a potassium hydroxide scrubber and into a 0° C. trap to afford 7.3 grams (58% yield) of 95% pure $CF_3CH_2CF_2CH_2CF_3$, boiling point 63°-64° C. (literature (F. A. Bloschchitsz et al., *J. Org. Chem. USSR, Engl. Transl.*, 21, 1286 (1985)) 62°-63° C.). 1H NMR ($CDCl_3$): δ 3.06 (m). 19F NMR: 63, 93.7 ppm upfield from $CFCl_3$. This Comparative hydrofluorocarbon was immiscible with octane at 25° C. as shown in Table V below.

COMPARATIVE C

This comparative is directed to the preparation of $CF_3(CF_2)_2CH_2CHFCH_3$ or 1,1,1,2,2,3,3,5-octafluorohexane.

A 600 milliliter autoclave was charged with 22.7 grams (0.1 mole) $CF_3(CF_2)_2CHOHCH_2CH_3$ prepared according to E. T. McBee et al., *J. Am. Chem. Soc.* 74, 1736 (1952) and 17 grams (0.157 mole) sulfur tetrafluoride at −78° C. On warming to 50° C., an exotherm occurred (to 70° C.) during the first 0.5 hour, and another (to 168° C.) during the second 0.5 hour. After cooling (ice bath), the mixture was stirred overnight and vented. The autoclave residue was poured into 100 milliliters ice-water, washed with cold dilute sodium hydroxide, and dried with magnesium sulfate to give 16 grams liquid. Distillation afforded 1 gram, boiling point 79°-80° (87% pure) and 5.9 grams, boiling point 80°-81° C. (95.3% pure) for a total of 6.9 grams (30%). The NMR spectra were not consistent with $CF_3(CF_2)_2CHFCH_2CH_3$, but rather with the rearranged product $CF_3(CF_2)_2CH_2CHFCH_3$. The presence of a $-CHFCH_3$ moiety was indicated by the 25 Hz F-C-$CH_3$ coupling in the 1H NMR spectrum (δ 1.47 (dd, $\underline{CH_3}$, J=7, 25 Hz), 2.4 (m, $CH_2$) 1 5. 1 (d of multiplets, CHF)). In the 19F spectrum, the CHF fluorine was observed at 173.5 ppm, which is in good agreement with the calculated (A. Battais et al., *J. Fluorine Chem.*, 31, 197 (1986)) value of 167.7 ppm for $CF_3(CF_2)_2CH_2CHFCH_3$, but considerably different from the calculated value for the CHF fluorine in $CF_3(CF_2)_2CHFCH_2CH_3$ (192.5 ppm). This Comparative hydrofluorocarbon was immiscible with dodecane at 25° C. as shown in Table VI below.

COMPARATIVE D

This example is directed to the preparation of $CF_3(CF_2)_2CHFCF(CH_3)_2$ or 5-methyl-1,1,1,2,2,3,3,4,5-nonafluoroheptane.

2-Methyl-4,4,5,5,6,6,6-heptafluoro-3-hexanone was prepared in 39% yield by the addition of isopropyl Grignard to perfluorobutyronitrile at −10° to 0° C. following the method of E. T. McBee et al., *J. Am. Chem. Soc.* 77, 917 (1955).

A 600 milliliter autoclave was charged with 14 grams of the above ketone (0.0583 mole), 20 milliliters dichloromethane, 0.1 milliliter ethanol, cooled, and evacuated briefly. Sulfur tetrafluoride (22.3 grams, 0.206 mole) was then added and on warming to room temperature, an exotherm occurred to 50°-60° C. Thereafter, the temperature was maintained at 60° C. for 66 hours. After the autoclave was vented to a potassium hydroxide scrubber, the contents were poured into cold water, and the organic layer washed with water and dried with magnesium sulfate. Distillation gave 6.1 grams, boiling point 90°-105° C. (91% purity). The product was not $CF_3(CF_2)_3CH(CH_3)_2$ but the rearranged material, $CF_3(CF_2)_2CHFCF(CH_3)_2$ as evidenced by a $\underline{CH_3}$-C-$\underline{F}$ coupling of 23 Hz and a $\underline{CHF}$ signal of a dddd at δ 4.8 (the CHF proton is coupled strongly to the geminal fluorine and additionally to 3 non-equivalent fluorines; the two fluorines of the $\underline{CF_2}$ CHF portion being diastereotopic). 1H NMR ($CDCl_3$): δ 1.56 (dd, J =1, 23 Hz), 4.8 (dddd, J approx. 44, 22, 12, 3 Hz). 19F NMR: 82.5 ($\underline{CF_3}$), 122 (d, $\underline{CF_2}$CHF, J=315 Hz), 129.5 (d, $\underline{CF_2}$CHF, J=315 Hz), 1 130 ($CF_3\underline{CF_2}$), 148 ($CF_3\underline{CF_2}$), 208.5 (CHF) ppm.

Re-distillation provided material of 95% purity, boiling point 90°-95° C. This Comparative hydrofluorocarbon was miscible with dodecane at 25° C.

COMPARATIVE E

This example is directed to the preparation of $CH_3(CF_2)_3CH_3$ or 2,2,3,3,4,4-hexafluoropentane.

A one liter flask equipped with a mechanical stirrer and water condenser was charged with 2,2,3,3,4,4-hexafluoropentane-1,5-diol-p-toluenesulfonate (110.6 grams, 0.213 mole), sodium iodide (103.1 grams, 0.688 mole), and 300 milliliters ethylene glycol. The reaction mixture was heated to 160° C. for 20 hours, cooled, and diluted with 200 milliliters water. The mixture was extracted twice with 350 milliliters ether. The combined organic layers were washed with dilute $NaHSO_3$ (3×150 milliliters), stirred over activated carbon, dried over magnesium sulfate, and the solvent removed under reduced pressure to give 90.16 grams crude $ICH_2(CF_2)_3CH_2I$. Recrystallization from petroleum ether afforded 61.3 grams (67% yield) of white needles. 1H NMR: δ 3.8 (t); 19F NMR: 107.5 (4F), 124 (2F) ppm upfield from internal $CFCl_3$.

A 100 milliliter flask equipped with a distillation take-off head and addition funnel was charged with 35 milliliters (37.9 grams, 0.13 mole) tributyltin hydride (nitrogen atmosphere). To the stirred hydride was added 24.7 grams (0.057 mole) of the above diiodide as a melt from the addition funnel at a rate such that the temperature of the reaction mixture did not exceed 40° C. When the addition was complete, the mixture was refluxed for 2 hours, and the product distilled directly from the reaction flask. Reduced pressure was used to remove the last of the product. The crude product so obtained was redistilled to give 8.13 grams (79% yield) of 99.8% pure 2,2,3,3,4,4-hexafluoropentane (boiling point 61.5° C.). 1H NMR: δ 1.8 (t); 19F NMR: 106.5 (4F) and 128.5 (2F) ppm. This comparative hydrofluorocarbon was miscible with dodecane at 25° C. as shown in Table V below.

COMPARATIVE F

This example is directed to the preparation of $CH_3(CF_2)_2CH_2CH_3$ or 2,2,3,3-tetrafluoropentane.

A 300-milliliter autoclave was charged with 2,3-pentanedione (22.5 grams, 0.225 mole), 22.5 grams hydrogen fluoride (1.125 moles), and 60 grams sulfur tetrafluoride (0.522 mole), stirred at room temperature for 4 hours, and the volatiles vented. The reactor contents were poured into 100 milliliters water and steam distilled. The organic layer was dried with magnesium sulfate to give 6.5 grams (26% yield) of 2,2,3,3-tetrafluoropentane, boiling point 47°-48° C. (literature (A. I. Burmakov et al., *J. Org. Chem. USSR, Engl. Trans.* 18, 1009 (1982) 46.5° C). 1H NMR ($CDCl_3$): 1.12 (t, 3H, J=7Hz), 1.78 (td, 3 H, J=1, 19.5 Hz), 1.4-2.4 (m, 2 H). 19F NMR ($CDCl_3$): δ 107.4 (m), 117.8 (m) ppm upfield from $CFCl_3$. This comparative hydrofluorocarbon was miscible with mineral oil at 25° C. as shown in Table V below but dissolved only 5 volume % of a perfluorinated polyether at 25° C. as shown in Table VII below.

EXAMPLE 1

This example is directed to the preparation of $(CF_3)_2CFCH_2CH_3$ or 2-trifluoromethyl-1,1,1,2-tetrafluorobutane.

A 500 milliliter flask fitted with a mechanical stirrer, distillation column, and take-off head was charged with 15 grams (0.046 mole) commercially available 4-iodo-2-trifluoromethyl-1,1,1,2-tetrafluorobutane, 28.5 grams (0.45 mole) zinc dust, and 230 milliliters 10% hydrogen chloride. As the mixture was stirred and heated to 50° C., 7.4 grams (80% yield) of distillate (boiling point 37°-39° C.) was collected. 1H NMR ($CDCl_3$) δ 2. 1 (m, 2 H), 1. 2 (t, 3H). This compound did not have a flashpoint (Setaflash, closed cup), and was miscible at room temperature with hexadecane as shown in Table V below, and silicone oil, and a perfluorinated polyether with an average molecular weight of 3500 as shown in Table VII below.

EXAMPLE 2

This example is directed to the preparation of $CF_3(CF_2)_2CH_2CH_3$ or 1,1,1,2,2,3,3-heptafluoropentane.

An autoclave was charged with 25 grams commercially available 3,3,4,4,5,5,5-heptafluoropentene, 2.2 grams 0.5% palladium/aluminum oxide, and pressurized with hydrogen to an initial pressure of 100 psig, and repressurized as necessary until hydrogen uptake was complete. After filtering the catalyst, the liquid was distilled to give 15 grams (63% yield) of $CF_3(CF_2)_2CH_2CH_3$, boiling point 410C (99.8.% purity). 1H NMR ($CDCl_3$) δ 2. 1 (m) 1 (t) . 19F NMR: 92, 118, and 129 ppm upfield from $CFCl_3$. This compound did not have a (closed cup) flashpoint, and was miscible with hexadecane at 27° C. as shown in Table V below.

EXAMPLE 3

This example is directed to the preparation of $CF_3(CF_2)_2(CH_2)_2CH_3$ or 1,1,1,2,2,3,3-heptafluorohexane.

1,1,1,2,2,3,3-heptafluoro-4-hexanol was prepared according to E. T. McBee et al, *J. Am. Chem. Soc.* 74, 1736 (1952) by the addition of $CF_3(CF_2)_2COOMe$ to ethyl magnesium bromide (boiling point 110°-114° C., 60% yield, 97% purity). 1H NMR ($CDCl_3$): δ 4.1 (m, 1H), 2.44 (s, 1 H), 1.8 (m, 2 H), 1.1 (t, 3H). The alcohol was converted into a mixture of $CF_3(CF_2)_2CH{=}CHCH_3$ and $CF_3$ $(CF_2)_2CH_2CH{=}CH_2$ by dehydration with phosphoric anhydride following the method of E. T. McBee et al., *J. Am. Chem. Soc.* 75, 2324 (1953) (19.1 grams from 25.1 grams alcohol, boiling point 59°-64° C.). The mixture of olefins was hydrogenated at room temperature over 0.5% palladium/aluminum oxide at an initial hydrogen pressure of 30 psig to give 13 grams crude $CF_3(CF_2)_2(CH_2)_2CH_3$ (93% one component by gas chromatography but olefin free). After distillation (boiling point 63.5°-64° C.; literature (R. H. Groth, *J. Org. Chem.* 24, 1709 (1959)), 64°-65° C.), the purity was 95%. This material was miscible with light mineral oil at 52° C.

EXAMPLE 4

This example is directed to the preparation of $CF_3(CF_2)_2CH(CH_3)_2$ or 4-methyl-1,1,1,2,2,3,3-heptafluoropentane.

Following the procedure of E. T. McBee et al. ibid, 2-methyl-3,3,4,4,5,5,5-heptafluoro-pentan-2-ol was prepared by adding methyl heptafluorobutyrate to 2 equivalents of methyl Grignard. The alcohol (boiling point 108° C.) was dehydrated with concentrated sulfuric acid to 2-methyl-3,3,4,4,5,5,5-heptafluoro-pent-1-ene (boiling point 55° C.). Hydrogenation of this olefin at 1500 psig using 5% rhodium/carbon gave 2-methyl-3,3,4,4,5,5,5-heptafluoropentane, boiling point 59°-61° C. 1H NMR ($CDCl_3$) δ 1.2 (d, 6 Hz), 2.45 (m). This compound was miscible with silicone oil with a perfluorinated polyether at 25° C. and with light mineral oil at 56° C.

A miniature vapor degreaser with a water-cooled copper coil condenser was charged with 8 milliliters of the prepared $CF_3(CF_2)_2CH(CH_3)_2$. A small spring coated with 0.0995 grams heavy mineral oil was lowered into the vapor phase of the degreaser for two minutes, removed, and weighed. The residual oil weighed 0.0083 gram indicating that 92% of the oil had been removed. The cycle was repeated. The weight of the residual oil after the second cycle was 0.0008 gram indicating that greater than 99% of the oil had been removed.

EXAMPLE 5

This example is directed to the preparation of $CF_3(CF_2)_3CH_2CH_3$ or 1,1,1,2,2,3,3,4,4-nonafluorohexane.

A 600 milliliter autoclave was charged with 25.7 grams (0.074 mole) commercially available perfluorobutyl iodide and heated to 200° C. Ethylene was added in (three) 50 psi increments with each followed by a moderate exotherm of 15°-30° C. The total amount of ethylene added was 10.4 grams (0.371 mole). After cooling the reactor and venting excess hydrogen, 24 grams pale brown material were collected. This was washed with aqueous $Na_2S_2O_3$, sodium bicarbonate, and dried over magnesium sulfate. The product was combined with 21 grams from a previous run and the unreacted perfluorobutyl iodide, 20.8 grams removed by distillation. The pot residue was identified as the desired $CF_3(CF_2)_3CH_2CH_2I$ (N. O. Brace et al., *J. org. Chem.* 49, 2361 (1984)) (57% yield, 97% purity) and was used in the next step without further purification. 19F NMR: 82 (3 F), 116 (2 F), 125 (2 F), and 127 (2 F) ppm upfield from $CFCl_3$.

A mixture of the above iodide (20.4 grams, 0.055 mole), 36.6 grams zinc dust (0.56 mole), and 250 milliliters 10% hydrogen chloride was stirred mechanically and heated to 70° C. The product, $CF_3(CF_2)_3CH_2CH_3$ (9.5 grams, 70% crude yield, distilled out of the flask as it was formed (head temperature 60°-65° C., literature (Y. K. Kim et al., *J. Org. Chem.* 38, 1615 (1973) b.p. 67° C.). 1H NMR: δ 1.1 (t), 1.6-2.5 (m). 19F NMR: 82, 118, 126, and 127 ppm upfield from $CFCl_3$. The product was miscible with perfluoropolyether at 25° C. and was miscible with dodecane at 47° C.

EXAMPLE 6

This example is directed to the preparation of $(CF_3)_2CFCH(CH_3)_2$ or 3-methyl-2-trifluoromethyl-1,1,1,2tetrafluorobutane.

Commercially available 2-fluoropropane (15 grams, 0.24 mole) was condensed into a chilled (−78° C.) 200 milliliter flask fitted with a dry-ice condenser, thermometer, and gas inlet tube, followed by the addition of 2 grams (0.001 mole) antimony pentafluoride. Hexafluoropropene (43 grams, 0.29 mole) was then added, and the mixture stirred for 2 hours at −78° C., and 2 hours at −45° C. The mixture was recooled to −78° C. and allowed to slowly warm to room temperature overnight. The product, 1,1,1,2-tetrafluoro-2-trifluoromethyl-3-methylbutane, was decanted from a dark insoluble residue, treated with a small amount of potassium fluoride and distilled to give 6.2 grams colorless liquid, boiling point 63.5°-64° C. of 99.9% purity by gas chromatographic analysis. 1H NMR ($CDCl_3$): δ 1.2 (d, J=6 Hz), 2. 5 (m); 19F NMR ($CDCl_3$-$CFCl_3$): 74.5 (d) and 178.5 ppm. This compound was miscible with light mineral oil at 54° C. and with a perfluorinated polyether at 25° C.

EXAMPLE 7

This example is directed to the preparation of $CF_3CF_2CH(CH_3)_2$ or 3-methyl-1,1,1,2,2-pentafluorobutane.

3,3,4,4,4-pentafluoro-2-methylbutane was prepared by the room temperature hydrogenation of 3,3,4,4,4-pentafluoro-2-methylbutene (54 rhodium/carbon, 1500 psi, 18 hours), boiling point 36°-37° C. 1H NMR ($CDCl_3$): δ 2.35 (m), 1.2 (d, J=6HZ); 19F NMR: 83 (s) and 124 (d) ppm. Light oil was miscible in this solvent at 30° C.

In Tables V, VI, and VII, the miscibility was determined by adding small volumes of solute to solvent at 25° C. until the solubility limit was reached at or near room temperature. The solutes tested were paraffinic light mineral oil (maximum Saybolt viscosity 158, hexadecane (molecular weight 226), dodecane (molecular weight 170), decane (molecular weight 142), octane (molecular weight 114), heptane (molecular weight 100), and hexane (molecular weight 86). In Tables V, VI, and VII, C-A stands for Comparative A, C-B stands for Comparative B, C-C stands for Comparative C, C-D stands for Comparative D, C-E stands for Comparative E, C-F stands for Comparative F, C-G stands for Comparative G, C-H stands for Comparative H, C-I stands for Comparative I, C-J stands for Comparative J, C-K stands for Comparative K, C-L stands for Comparative L, and C-M stands for Comparative M.

In Table V below, MISCIBLE HYDROCARBON means the highest molecular weight hydrocarbon that was miscible at 25° C. with the following hydrocarbons tested: mineral oil, hexadecane, dodecane, decane, octane, heptane, and hexane.

TABLE V

SOLVENCY DATA AT 25° C. FOR HYDROFLUOROPENTANES

| COMPARATIVE OR EXAMPLE | COMPOUND | % FLUORINE | MISCIBLE HYDROCARBON |
|---|---|---|---|
| C-G | $CH_3(CH_2)_3CH_3$ | 0 | mineral oil |
| C-H | $CH_3CH_2CF_2CH_2CH_3$ | 35 | mineral oil |
| C-A | $CH_3CF_2CH_2CF_2CH_3$ | 53 | dodecane |
| C-F | $CH_3(CF_2)_2CH_2CH_3$ | 53 | mineral oil |
| C-E | $CH_3(CF_2)_3CH_3$ | 63 | dodecane |
| C-I | $CF_3(CH_3)CHCH_2CF_3$ | 63 | dodecane |
| Example 1 | $(CF_3)_2CFCH_2CH_3$ | 67 | hexadecane |
| C-J | $HCF_2CF_2CH_2CH_2CF_3$ | 67 | decane |
| Example 2 | $CF_3(CF_2)_2CH_2CH_3$ | 67 | hexadecane |
| C-B | $CF_3CH_2CF_2CH_2CF_3$ | 70 | hexane |
| C-K | $CF_3CH_2CH(CF_3)_2$ | 73 | octane |

TABLE V-continued

| SOLVENCY DATA AT 25° C. FOR HYDROFLUOROPENTANES | | | |
|---|---|---|---|
| COMPARATIVE OR EXAMPLE | COMPOUND | % FLUORINE | MISCIBLE HYDROCARBON |
| C-L | $CF_3(CF_2)_3CF_3$ | 79 | hexane |

TABLE VI

| SOLVENCY DATA AT 25° C. FOR HYDROFLUOROHEXANES | | | |
|---|---|---|---|
| COMPARATIVE OR EXAMPLE | COMPOUND | % FLUORINE | SOLUBLE HYDROCARBON |
| Example 3 | $CF_3(CF_2)_2(CH_2)_2CH_3$ | 63 | hexadecane |
| C-C | $CF_3(CF_2)_2CH_2CHFCH_3$ | 66 | decane |
| Example 4 | $CF_3(CF_2)_2CH(CH_3)_2$ | 63 | hexadecane |
| Example 6 | $(CF_3)_2CFCH(CH_3)_2$ | 63 | hexadecane |
| Example 5 | $CF_3(CF_2)_3CH_2CH_3$ | 69 | dodecane |

In Table VII, solubility was calculated by: (solute volume)/volume(solute and solvent)]×100. Insoluble means that less than 2 volume percent of perfluorinated polyether was soluble in the compound.

TABLE VII

| SOLUBILITY AT 25° C. OF PERFLUORINATED OIL | | | |
|---|---|---|---|
| COMPARATIVE OR EXAMPLE | COMPOUND | % FLUORINE | SOLUBILITY |
| Example 1 | $(CF_3)_2CFCH_2CH_3$ | 67 | ≧50 volume % |
| Example 4 | $CF_3(CF_2)_2CH(CH_3)_2$ | 63 | ≧50 volume % |
| Example 7 | $CF_3CF_2CH(CH_3)_2$ | 59 | ≧50 volume % |
| C-F | $CH_3(CF_2)_2CH_2CH_3$ | 53 | 5 volume % |
| C-M | $CH_2FCH_2CH_2F$ | 48 | insoluble |
| C-H | $CH_3CH_2CF_2CH_2CH_3$ | 35 | insoluble |

Having described the invention in detail and by reference to preferred embodiments thereof, it will be apparent that modifications and variations are possible without departing from the scope of the invention defined in the appended claims.

What is claimed is:

1. A method of dissolving contaminants or removing contaminants from the surface of a substrate selected from the group consisting of organic or inorganic surfaces or natural or synthetic fabrics and blends or composites thereof which comprises the step of: exposing said substrate to at least one solvent of the:

(A) Formula (I)

$$C_nF_{2n+1}C_mH_{2m+1}$$

wherein n is 2, 3, or 4 and m is 2 or 3;

(B) Formula (II)

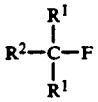

wherein $R^1$ is the same or different and is selected from the group consisting of $—CH_3$ and $—C_2H_5$ and $R^2$ is selected from the group consisting of $—CH_3$, $—CH_2CH_3$, $—(CF_2)_2CF_3$, and $—FC(CF_3)_2$; or (C) Formula (III)

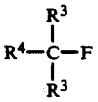

wherein $R^3$ is the same or different and is selected from the group consisting of $—CF_3$, $—C_2F_5$, and $—C_3F_7$ and $R^4$ is selected from the group consisting of $—CH_3$ and $—C_2H_5$ with the proviso that both of $R^3$ cannot be $—CF_3$.

2. The method of claim 1 wherein said solvent is of Formula (I).

3. The method of claim 2 wherein said solvent is 1,1,1,2,2-pentafluorobutane.

4. The method of claim 2 wherein said solvent is selected from the group consisting of 1,1,1,2,2-pentafluoropentane and 2-methyl-3,3,4,4,4-pentafluorobutane.

5. The method of claim 2 wherein said solvent is selected from the group consisting of 2-trifluoromethyl-1,1,1,2-tetrafluorobutane and 1,1,1,2,2,3,3-heptafluoropentane.

6. The method of claim 2 wherein said solvent is selected from the group consisting of 1,1,1,2,2,3,3-heptafluorohexane; 2-trifluoromethyl-1,1,1,2-tetrafluoropentane; 4-methyl-1,1,1,2,2,3,3-heptafluoropentane; and 3-methyl-2-trifluoromethyl-1,1,1,2-tetrafluorobutane.

7. The method of claim 2 wherein said solvent is selected from the group consisting of 1,1,1,2,2,3,3,4,4-nonafluorohexane; 2-trifluoromethyl-1,1,1,2,3,3-hexafluorofluoropentane; 2,2-(bis)trifluoromethyl-1,1,1-trifluorobutane; and 1,1,1,2,2,3-hexafluoro-3-trifluoromethylpentane.

8. The method of claim 2 wherein said solvent is selected from the group consisting of 1,1,1,2,2,3,3,4,4-nonafluoroheptane; 5-methyl-1,1,1-2,2,3,3,4,4-nonafluorohexane; 2-trifluoromethyl-1,1,1,2,3,3-hexafluorohexane; 4-methyl-2-trifluoromethyl-1,1,1,2,3,3-hexafluoropentane; 2,2-trifluoromethyl-1,1,1-trifluoropentane; 3-methyl-2,2-trifluoromethyl-1,1,1-trifluorobutane; 1,1,1,2,2,3-hexafluoro-3-trifluoromethylhexane; and 1,1,1,2,2,3-hexafluoro-3-trifluoromethyl-4-methylpentane.

9. The method of claim 2 wherein said method dissolves or removes organic contaminants.

10. The method of claim 2 wherein said method dissolves or removes hydrocarbon contaminants.

11. The method of claim 2 wherein said method dissolves or removes fluorocarbon contaminants.

12. The method of claim 1 wherein said solvent is of Formula (II).

13. The method of claim 12 wherein said solvent is selected from the group consisting of 2-trifluoromethyl-2-fluoropropane; 2-methyl-1,1,1,2-tetrafluorobutane; 3-methyl-1,1,1,2,2,3-hexafluoropentane; 4-methyl-1,1,1,2,2,3,3,4-octafluorohexane; and 3-methyl-2-trifluoromethyl-1,1,1,2,3-pentafluoropentane.

14. The method of claim 1 wherein said solvent is of Formula (III).

15. The method of claim 14 wherein said solvent is selected from the group consisting of 2-methyl-1,1,1,3,3,4,4,4-octafluorobutane; 3-methyl-1,1,1,2,2,4,4,5,5,5-decafluoropentane; 2-methyl-1,1,1,3,3,4,4,5,5,5-decafluoropentane; 3-trifluoromethyl-1,1,1,2,2-pentafluoropentane; 3-pentafluoroethyl-1,1,1,2,2-pentafluoropentane; and 4-trifluoromethyl-1,1,1,2,2,3,3-heptafluorohexane.

* * * * *

UNITED STATES PATENT AND TRADEMARK OFFICE

CERTIFICATE OF CORRECTION

PATENT NO. : 5,275,669

DATED : January 4, 1994

INVENTOR(S) : M. Van Der Puy, P.J. Persichini, A.J. Poss, L.A. Shorts and R.E. Eibeck It is certified that error appears in the above-identified patent and that said Letters Patent is hereby corrected as shown below:

Column 13:

In claim 1, line 15, delete "$-CH_3$, $-CH_2CH_3$, $-(CF_2)_2CF_3$" and insert --

$-CF_3$, $-CF_2CF_3$, $-(CF_2)_2CF_3$ --.

Signed and Sealed this

Twenty-seventh Day of December, 1994

*Attest:*

Bruce Lehman

BRUCE LEHMAN

*Attesting Officer*

*Commissioner of Patents and Trademarks*